United States Patent [19]

Hattori

[11] 4,214,631

[45] Jul. 29, 1980

[54] SPRINKLER HEAD WITH HEAT SENSITIVE COVER RELEASE AND VALVE RELEASE MECHANISM

[76] Inventor: Tadashi Hattori, 15-20, 1-chome, Kamori-cho, Kishiwada-shi, Osaka-fu, Japan

[21] Appl. No.: 965,504

[22] Filed: Dec. 1, 1978

[30] Foreign Application Priority Data

Aug. 8, 1978 [JP] Japan ..... 53-111005[U]
Aug. 8, 1978 [JP] Japan ..... 53-111006[U]

[51] Int. Cl.[2] ..... A62C 37/12

[52] U.S. Cl. ..... 169/57; 169/40; 169/42

[58] Field of Search ..... 169/26, 37–42, 169/90, 57; 126/287.5; 239/498, 500, 502, 504, 506, 522–524, 288, 288.3, 288.5; 137/72

[56] References Cited

U.S. PATENT DOCUMENTS

| | | | |
|---|---|---|---|
| 489,342 | 1/1893 | Stratton | 169/41 |
| 2,591,872 | 8/1952 | Rider | 169/42 |
| 2,639,947 | 5/1953 | Tramm et al. | 239/504 X |
| 3,525,402 | 8/1970 | Hattori | 169/40 |
| 3,727,695 | 4/1973 | Danton | 169/37 |
| 4,014,388 | 3/1977 | Anderson | 169/37 |

FOREIGN PATENT DOCUMENTS

| | | | |
|---|---|---|---|
| 2134461 | 1/1972 | Fed. Rep. of Germany | 169/38 |

*Primary Examiner*—Robert J. Spar
*Assistant Examiner*—Fred A. Silverberg
*Attorney, Agent, or Firm*—George B. Oujevolk

[57] ABSTRACT

A sprinkler head with a valve automatically detachable when the temperature is raised to such extent that there is a danger of the outbreak of a fire in a room. The sprinkler head has a water discharge valve seat in the lower center of a discoidal body, a plurality of supporting legs being formed on the outside of the valve seat. A valve in contact with the valve seat is supported by a heat sensitive sustaining unit having a plurality of levers, a fusible retainer disposed on said supporting legs holding the valve and the cover. A deflector made of a thin material having a multiplicity of sprinkling outlets is mounted on the lower part of the body. There is a cover on the outer side of the deflector which is released by the heat sensitive unit.

1 Claim, 19 Drawing Figures

SPRINKLER HEAD WITH HEAT SENSITIVE COVER RELEASE AND VALVE RELEASE MECHANISM

BACKGROUND OF THE INVENTION

The invention relates to a sprinkler head, and particularly to sprinkling outlets of a sprinkler head having a construction in which a deflector made of a thin material is secured to the lower part of a discoidal body and a cover for shielding the deflector.

BRIEF DESCRIPTION OF THE PRIOR ART

In the conventional sprinkler head, two methods were adopted to disperse the jet water while retaining the pressure inside the deflector: one was to disperse the water by rotation, while the other was to provide a multiplicity of slit-like elongated holes or variform small holes in the direction of the dispersion of water. These method had a disadvantage in that not only the construction was complicated but also the holes were not free from the danger of being clogged by foreign matters in the piping. These methods had a further disadvantage in that dust infiltrating from outside into the deflector through its sprinkling outlets caused a failure in operation in time of emergency when the sprinkler head was installed in a dusty place.

OBJECTS OF THE INVENTION

An object of the invention is to provide a cover to shield the sprinkling outlets and the deflector of the sprinkler head in order to obviate the above-mentioned difficulties.

Further objects, construction and features of the sprinkler head according to the invention will become apparent from the description taken in reference to the accompanying drawings.

DETAILED DESCRIPTION

Figure 1:
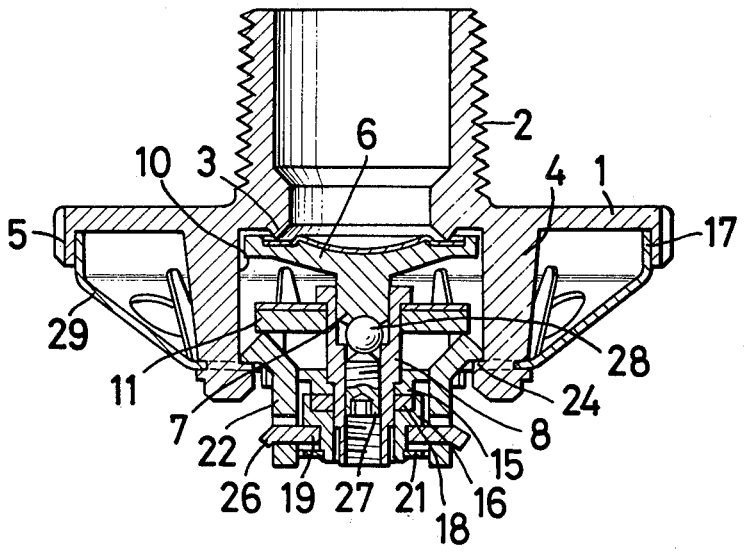
FIG. 1 is a longitudinal sectional elevation showing a first embodiment of the sprinkler head according to the invention.
Figure 4:
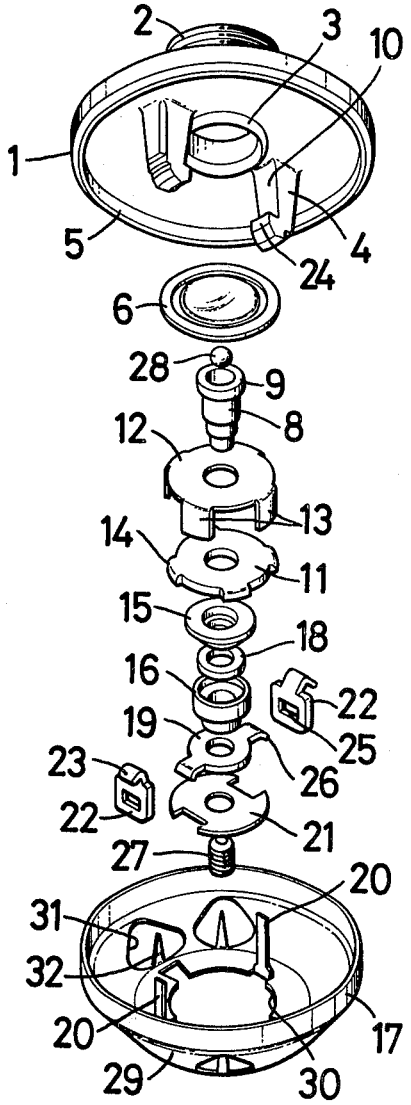
FIG. 4 is an exploded perspective view of the sprinkler head of FIG. 1.

Referring to FIGS. 1 and 4 showing the first embodiment of the invention, the numeral 1 designates a discoidal body formed by casting or the like, a threaded tube 2 for connecting a water pipe thereto being provided in the upper center of the body 1, a water discharge valve seat 3 being formed in the lower center thereof, a supporting leg 4 being integrally formed on each side of the valve seat 3, a downward edge 5 being formed on the outer periphery of the body 1.

The numeral 6 designates a valve with a packing of sheet copper or the like superposed thereon, a valve spindle 7 being erected in the lower center thereof, the upper end of a guide sleeve 8 being fitted onto the valve spindle 7, a spring-guide 11 with a seat plate 12 superposed thereon being loosely fitted through its central hole onto the sleeve 11 so as to be supported by a flange 9 at its upper end. Guide pieces 13 downwardly provided on the outer periphery of the seat plate are fitted between projections 14 on the outer periphery of the guide 11.

An upper ring 15 is externally fitted onto the sleeve 8 so that its upper part is received by a shoulder of said sleeve 8, an annular fusible member 18 being fitted below the lower part of the upper ring 15, a lower ring 16 being fitted in such manner that the fusible member 18 is interposed between the upper and lower rings 15, 16.

The numeral 19 designates an annular balancer fitted onto a small diameter portion of the lower part of the lower ring 16, a heat collector 21 being secured further therebelow, a supporter at each side of the balancer 19 being engaged with an engageing hole at the lower end of each of a pair of levers 22. The top of an angle 23 on the outside of the upper end of each lever 22 is brought into contact with the lower part of the outer periphery of the guide 11 while the lower part of the outer end of the angle 23 is engaged with a receiver 24 on the inside of the lower end of each supporting leg 4.

The numeral 27 designates a pressure screw screwed into female threads inside the sleeve 8, a ball 28 being interposed between the upper end of the pressure screw 27 and the lower end of the valve spindle 7.

The numeral 29 designates a deflector made by press-molding a thin metal sheet or the like. The deflector 29 has a tapering shape, the upward edge 17 of its outer periphery being fitted inside the downward edge 5 of the body 1 and secured thereto by means of caulking or by the use of an adhesive. In the center of the deflector 29 is formed an opening 30 permitting the heat collector 21, the lower ring 16, levers 22, etc. to project therethrough. When the opening 30 is formed, an elongated piece is left at two points of the peripheral edge of said opening 30, said elongated pieces being erected upright on the peripheral edge so as to serve as guide shafts 20. The guide shafts 20 are provided most adjacent the outer periphery of the valve 6, while the inner sides of the supporting legs 4 are adapted to have vertical faces adjacent the outer periphery of the valve 6 so as to serve as guide faces 10.

Furthermore, the deflector 29 is provided with a plurality of substantially triangular sprinkling outlets 31, an elongated triangular projection 32 being erected inside the deflector 29 so as to stand upright from the middle of a side corresponding to the base of each sprinkling outlet 31 adjacent the center of the deflector 29 thereby enabling the water to be dispersed.

Figure 2:
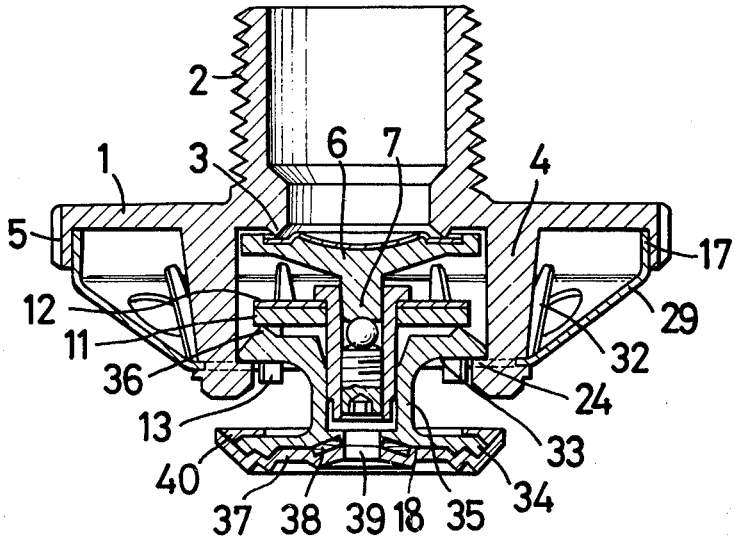
FIG. 2 is a longitudinal sectional elevation showing a second embodiment.

A second embodiment shown in FIG. 2 has some parts in common with the first embodiment. Therefore, description will be given hereunder in connection with the different parts only.

In the second embodiment are used a pair of levers 35 each having an outward upper element 33 and lower element 34, the top of an angle 36 at the outer end of the upper element 33 being brought into contact with the lower part of the guide 11, while the lower part of said angle 36 is engaged with a receiver 24, respectively. Indentation formed on the underside of the lower element 34 are engaged with the corresponding indentation formed on an annular coupler 37, a core ring 40 being superposed on both lower elements 34, a skid-proof key 38 being interposed between the coupler 37 and each lower element, a fusible member being applied between the lower element 34, the coupler 37 and the core ring 40 for integral adhesion thereof. The lower elements 34 and the coupler 37 project downwardly through and beyond the opening 30 of the deflector 29. In the center of the coupler 37 is provided an insertion hole 39 for a wrench for revolving the pressure screw 27.

Figure 3:
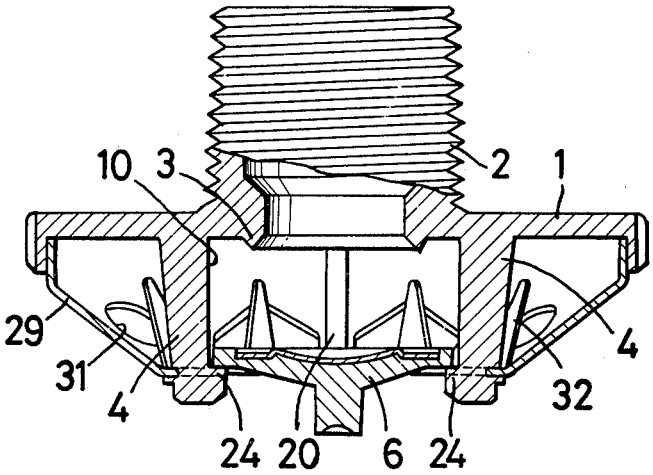
FIG. 3 is a longitudinal sectional elevation at the time of sprinkling of the same.
Figure 7:
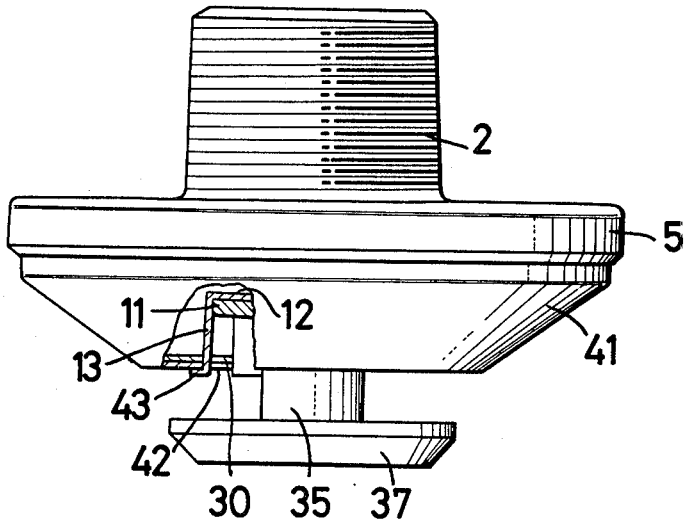
FIG. 7 is a longitudinal sectional side view of the engageing part of the cover.

The sprinkler head according to the invention has a construction as described hereinbefore. In the state as shown in FIGS. 1 and 2, the water pressure applied to the valve 6 through the threaded tube 2 is sustained by a heat sensitive sustaining unit comprising the guide 11, the levers 22 or 35 and the like. If the fusible member is melted due to, for example, the outbreak of a fire, said heat sensitive sustaining unit disintegrates and falls, the released valve 6 lowering until it is horizontally supported by the receivers 24 of the supporting lets as shown in FIG. 3. Thus, the water discharged from within the valve seat 3 is dispersed in collision with the valve 6, the water being further dispersed by the projections 32 erected adjacent the inner sides of the sprinkling outlets 31 respectively until it is sprinkled through the sprinkling outlets 31.

The first and second embodiments perform the operation as described hereinbefore. The sprinkler head is adapted to disperse and sprinkle water while retaining pressure inside the deflector which is made of thin material and mounted on a discoidal body. It is particularly to be noted that a projection 32 is erected adjacent the inner side of each sprinkling outlet 31 provided in multiplicity on the deflector 29, that is, in the middle of the side corresponding to the base of each triangular sprinkling outlet 31, whereby the water dispersed in collision with the valve 6 is further dispersed in collision with the projections 32 until it is sprinkled through the sprinkling outlets 31. Thus the water is sprinkled uniformly all over a wide range without deflection.

Figure 5:
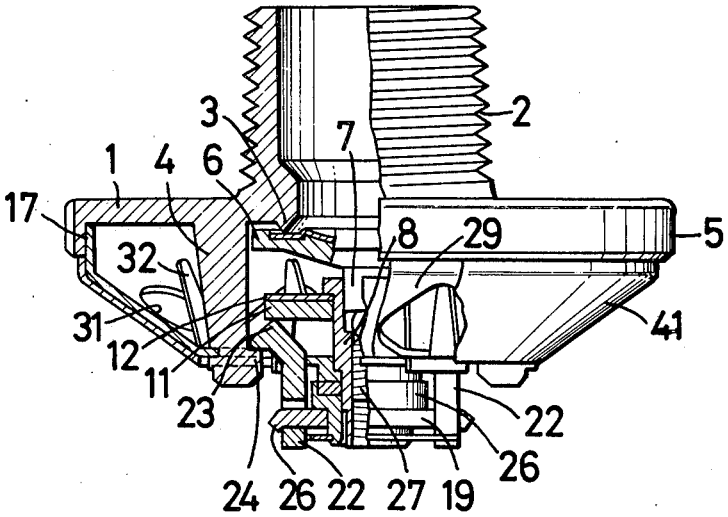
FIG. 5 is a fragmentary longitudinal sectional elevation showing an example of a sprinkler head with a cover constituting a third embodiment of the invention.
Figure 6:
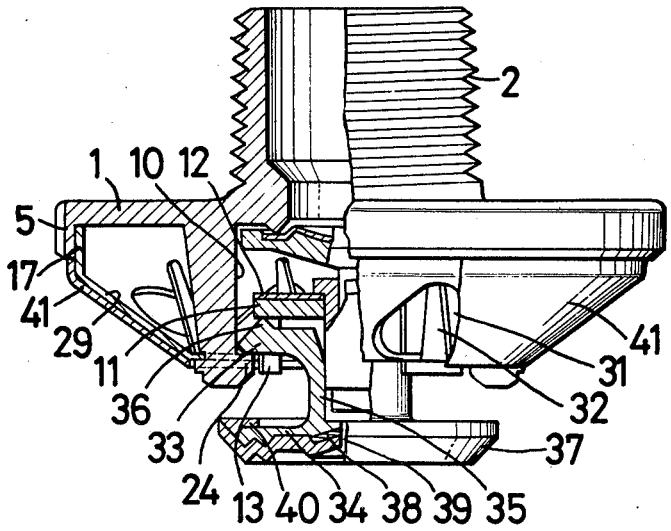
FIG. 6 is a fragmentary longitudinal sectional elevation showing an example of a sprinkler head constituting a fourth embodiment of the invention.
Figure 8:
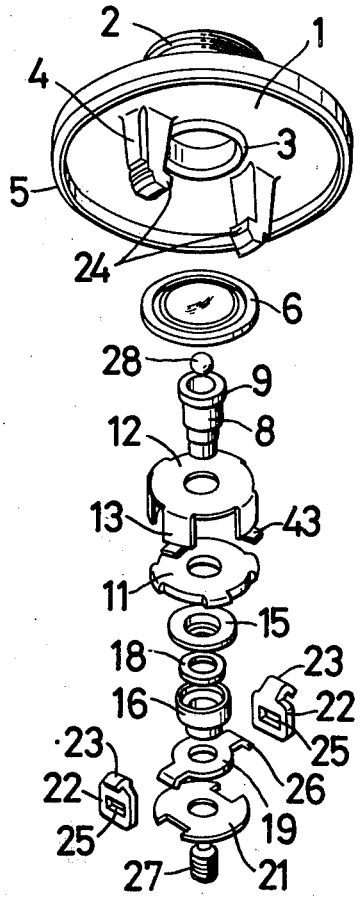
FIG. 8 is an exploded perspective view of the sprinkler head of FIG. 5.

A third and fourth embodiments as shown in FIGS. 5 and 6 will be described in detail hereinunder. Since they are same as the first and second embodiments except the cover, the description will be limited to the different parts.

The numeral 41 designates a cover made by press-molding a thin metal sheet or the like. The cover 41 has a tapering shape so as to fit the outside of the deflector 29. It has an opening 42 in the center thereof, the lower ends of the guide pieces 13 being fitted into the opening 42, catches 43 at the lower ends thereof being engaged with the lower part of the peripheral edge of the opening 42, the upper end of the cover 41 being brought into contact with the lower part of the downward edge 5 of the body 1.

The third and fourth embodiments have the above-described construction. In the state as shown in FIGS. 5 and 6, the water pressure applied to the valve 6 through the threaded tube 2 is sustained by a heat sensitive sustaining unit comprising the guide 11, the levers 22 or 35 and the like. If the fusible member is melted due to, for example, the outbreak of a fire, the heat sensitive sustaining unit disintegrates and falls, the released valve 6 lowering until it is supported horizontally by the receivers provided on the supporting legs 4 as shown in FIG. 2.

When the heat sensitive sustaining unit disintegrates as described hereinbefore, the spring-guide 11 supported by the levers 22 or 35 also disintegrates, the guide pieces 13 lowering along the openings 30, 42, the catches 43 at the lower ends of the guide pieces 13 being disengaged from the opening 42 of the cover 41. Thus the cover 41 falls off the surface of the deflector 29, the sprinkler head being now in the state in which the released valve alone is supported horizontally by the receivers 24 as shown in FIG. 2. As a result, the water discharged from within the valve seat 3 is dispersed in collision with the valve 6 until it is sprinkled through the sprinkling outlets of the deflector 29.

The third and fourth embodiments perform the above-mentioned operation. Since the sprinkler head comprises a discoidal body and a deflector made of thin material, it is not only very light in weight but also producible with economy. Particularly, the sprinkler head has an advantage in that infiltration of dust through the sprinkling outlets is completely excluded since they are closed by the cover spread over the deflector. It has a further advantage in that there is no danger of the cover being inadvertently detached insofar as the sensitive sustaining unit is intact since a plurality of outward catches at the lower ends of the downward guide pieces provided on the outer periphery of the seat plate of the heat sensitive sustaining unit inside the deflector engage with the lower side of the peripheral edge of the opening in the center of the cover, while sprinkling is performed with reliability since the cover is quickly detached when the heat sensitive sustaining unit disintegrates with the outbreak of a fire.

Figure 10:
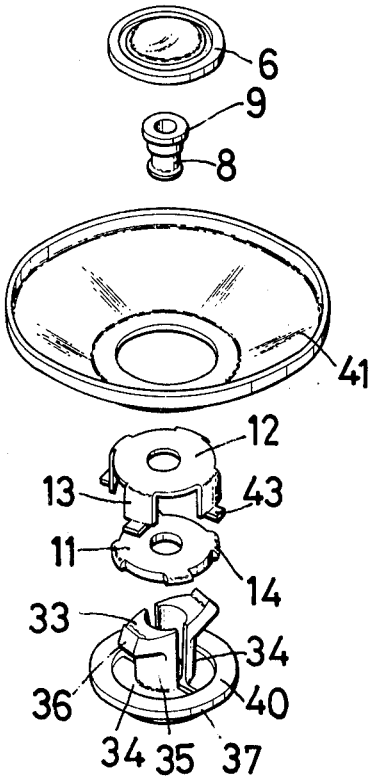
FIG. 10 is a fragmentary knockdown perspective of the sprinkler head of FIG. 9.
Figure 9:
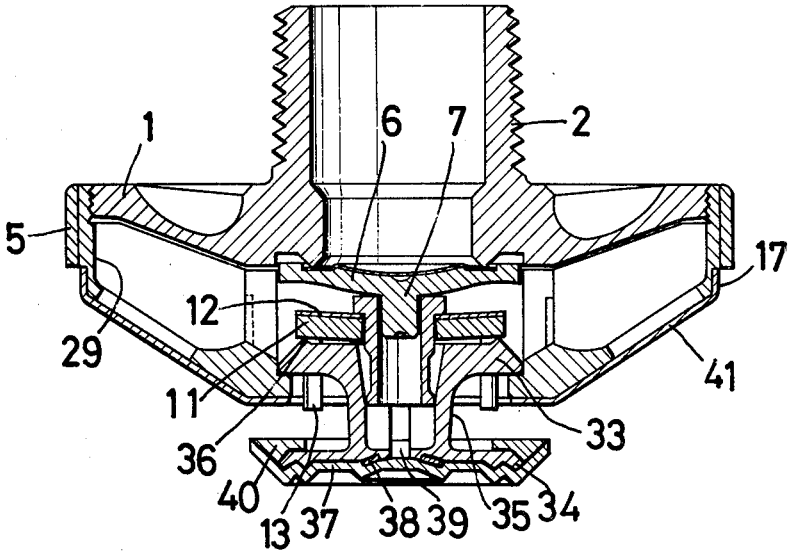
FIG. 9 is a longitudinal sectional elevation of a sprinkler head constituting a fifth embodiment of the invention.
Figure 11:
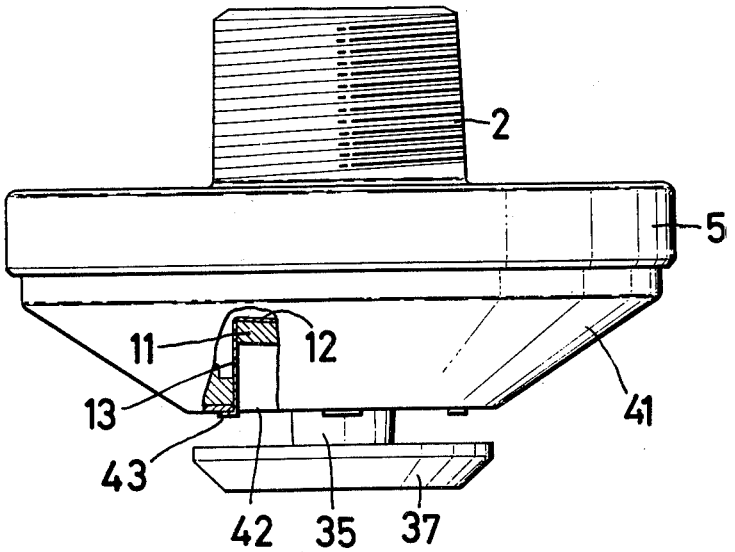
FIG. 11 is a fragmentary longitudinal sectional side view showing the other side of FIG. 9.

The sprinkler head, a fifth embodiment, shown in FIGS. 9 to 11 and the sprinkler head shown in FIGS. 12, 14, 16 and 18 are the same sprinkler heads as those publicly known under U.S. Pat. No. 3,525,402 and British Pat. No. 1,313,897 respectively which have been obtained by the present applicant. The only difference consists in that the sprinkling outlets and the deflector are shielded with a cover thereby enabling to preclude dust from infiltrating into the deflector through the sprinkling outlets. The sprinkler head shown in FIGS. 9 to 11 has outward catches 43 at the lower ends of the guide pieces 13, said catches 43 supporting the cover by engaging with the underside of the peripheral edge of the opening in the center of the cover 41.

Figure 12:
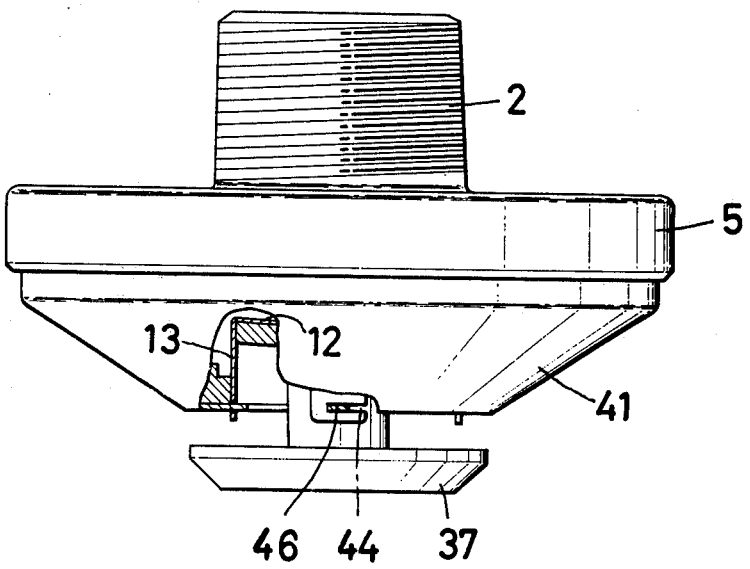
FIGS. 12 to 17 show sprinkler heads in which the cover and downward guide pieces are sustained by different engageing means respectively though the construction is same as that of the sprinkler head of FIG. 9.
Figure 13:
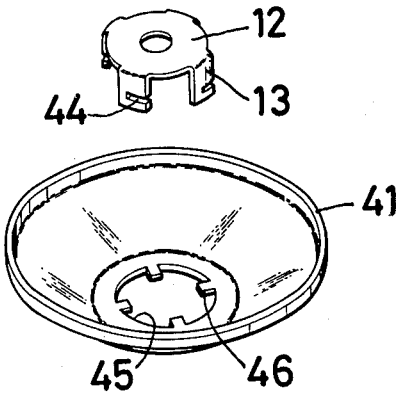

The sprinkler head shown in FIGS. 12 and 13 has a notch 44 provided on each downward guide piece 13, on the peripheral edge of the opening 45 of the cover 41 being provided a projection 46 engageable with each notch 44, the cover being applied to the outside of the deflector by engaging the projections 46 with the notches 44.

Figure 14:
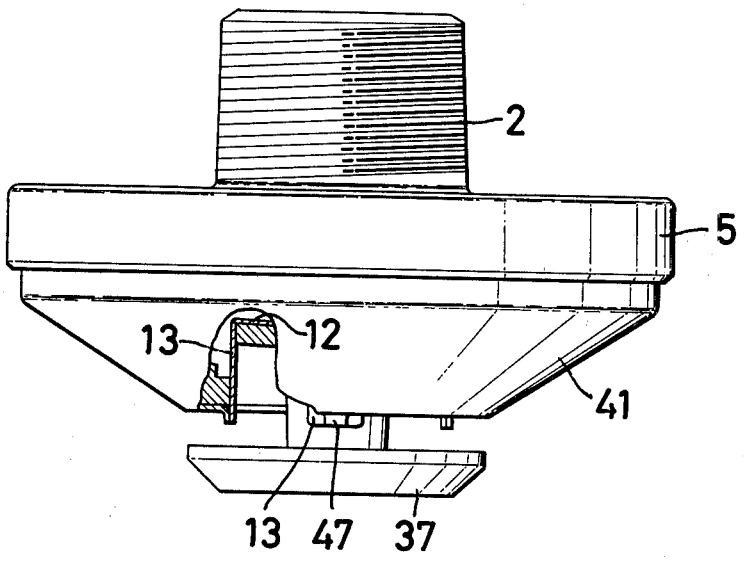
Figure 15:
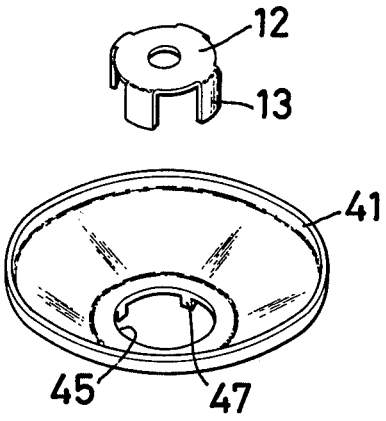

In the sprinkler head shown in FIGS. 14 and 15, downward projections 47 are provided on the peripheral edge of the opening in the center of the cover so as to correspond with the guide pieces 13 of the seat plate, respectively, the cover being applied to the outside of the deflector by connecting the guide pieces 13 with the downward projections 47 by suitable means.

Figure 16:
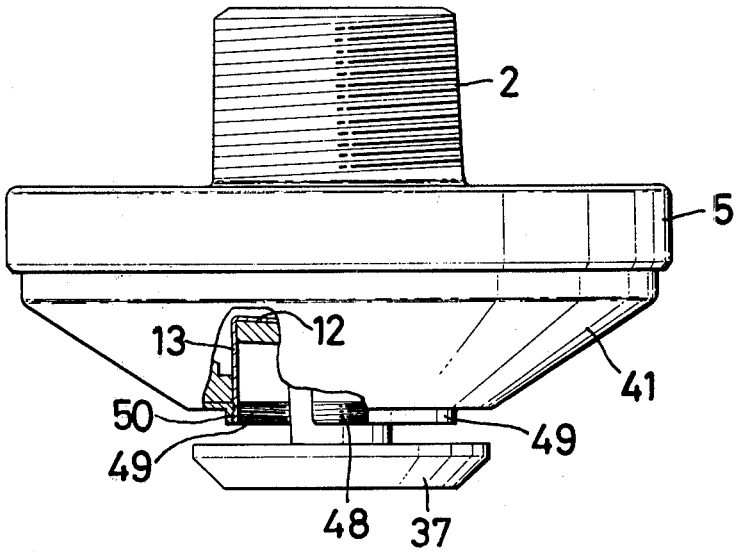
Figure 17:
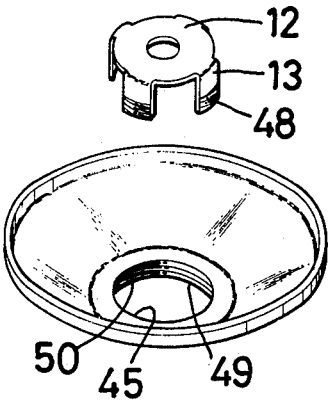

In the sprinkler head shown in FIGS. 16 and 17, threads 48 are provided in the lower part of each downward guide piece 13, a downwardly projecting edge 49 being provided on the periphery of the opening 45 of the cover 41, threads 50 being provided on said projecting edge 49. The cover is applied to the outside of the deflector by screwing its threads 50 into the threads 48 of the guide pieces.

Figure 18:
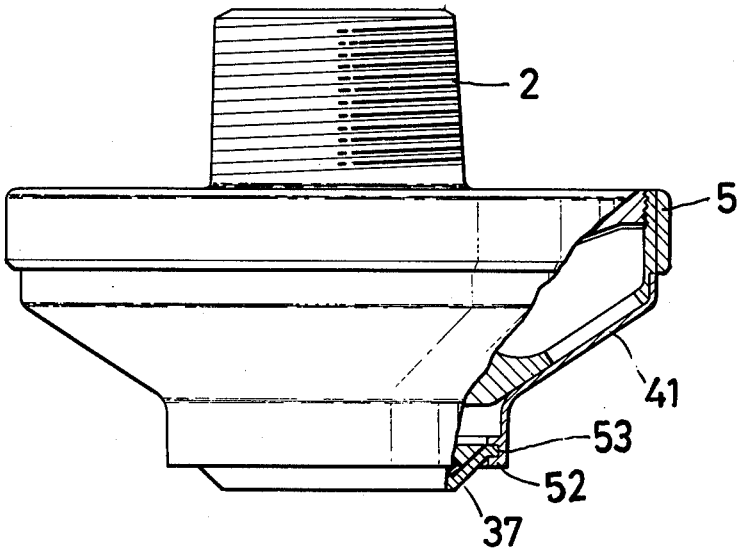
FIGS. 18 and 19 show a sprinkler head in which the cover is sustained by the engagement with a coupling plate though the construction is same as that of the sprinkler head of FIG. 9.
Figure 19:
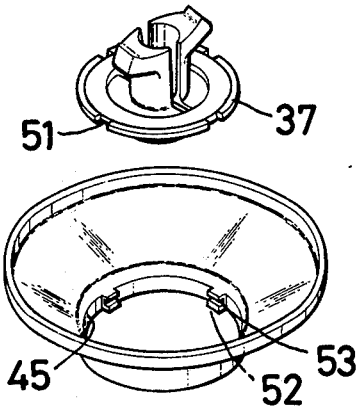

In the sprinkler head shown in FIGS. 18 and 19, a plurality of notches 51 are provided on the coupler 37, projections 52 corresponding with said notches 51 being provided on the peripheral edge of the opening 45 in the center of the cover 41, an engaging recess 53 being provided on each projection 52 thereby enabling to hold the peripheral edge of the coupler 37. The cover 41 is applied by first fitting the projections 52 of the cover 41 into the notches 51 of the coupler 37, then the cover 41 being rotated to some extent so that the peripheral edge of the coupler is engaged with the engaging recesses 53 of the projections 52.

In each of the embodiments described hereinbefore, the sprinkling outlets of the deflector are closed by the cover same as in the case of the third and fourth embodiments. Therefore, there is no danger of dust infiltrating into the deflector through the sprinkling outlets.

What is claimed is:

1. A sprinkler head, comprising in combination:

(a) an externally threaded straight tube (2) with a fluid supply forward end for supplying fluid in the forward direction therefrom;

(b) a disc-like body (1) with a lower part connected to said supply end;

(c) a central portion in said body (1) with a water discharge valve seat (3) defined in said central portion;

(d) a plurality of supporting legs (4) formed in said lower part and extending in the forward direction from said body (1) outside of said valve seat and having a receiver on the inside of the forward end of each said leg;

(e) a valve (6) in contact with said valve seat;

(f) heat fusible means engaging said valve through a guide sleeve to hold the valve in contact with said valve seat and being connected to said legs through lever means, said lever means engaging the receiver of each said leg;

(g) a thin deflector (29) with a multiplicity of small sprinkling apertures mounted on said lower part, extending radially outward of said legs in the direction of the periphery of said disc-like body (1) over said body;

(h) elongated projections (32) inside said deflector extending rearwards in the direction of said tube;

(i) a guide (13) mounted on said lever means through a spring guide and being held in place by said heat fusible means, said guide having catches at the forward end; and, (j) a cover having a tapering shape to fit the outside of the deflector and having an opening in the center, the forward end of the guide being fitted into the cover opening so that the catches at the forward end of the guide engage the forward part of the peripheral edge of the opening.

* * * * *